US011585119B2

(12) United States Patent
Drechsel et al.

(10) Patent No.: US 11,585,119 B2
(45) Date of Patent: Feb. 21, 2023

(54) JOINT LOCK

(71) Applicant: ABUS August Bremicker Söhne KG, Wetter-Volmarstein (DE)

(72) Inventors: Christian Drechsel, Breitscheid (DE); Thomas Lind, Freudenberg (DE)

(73) Assignee: ABUS AUGUST BREMICKER SÖHNE KG, Wetter-Volmarstein (DE)

( * ) Notice: Subject to any disclaimer, the term of this patent is extended or adjusted under 35 U.S.C. 154(b) by 392 days.

(21) Appl. No.: 16/878,670

(22) Filed: May 20, 2020

(65) Prior Publication Data

US 2020/0370334 A1 Nov. 26, 2020

(30) Foreign Application Priority Data

May 20, 2019 (DE) ..... 102019113378.5

(51) Int. Cl.

| | |
|---|---|
| ***E05B 37/02*** | (2006.01) |
| ***E05B 15/16*** | (2006.01) |
| ***E05B 67/00*** | (2006.01) |
| *E05B 71/00* | (2006.01) |

(52) U.S. Cl.

CPC ..... *E05B 37/02* (2013.01); *E05B 15/1614* (2013.01); *E05B 67/003* (2013.01); *E05B 71/00* (2013.01)

(58) Field of Classification Search

CPC ..... E05B 71/00; E05B 73/0005; E05B 37/02; E05B 15/1614; E05B 67/003; Y10T 70/417

USPC ..... 70/22, 14, 233, 225, 226

See application file for complete search history.

(56) References Cited

U.S. PATENT DOCUMENTS 4,896,517 A 1/1990 Ling
5,964,107 A * 10/1999 Chang ..... E05B 29/0066 70/226
6,386,005 B1 5/2002 Kuo
(Continued)

FOREIGN PATENT DOCUMENTS

CN 2490275 Y 5/2002
CN 104295163 A 1/2015
(Continued)

*Primary Examiner* — Suzanne L Barrett
(74) *Attorney, Agent, or Firm* — Dickinson Wright PLLC

(57) ABSTRACT

A joint lock comprises a lock body that accommodates a combination locking mechanism; and a jointed bar hoop. The combination locking mechanism has a plurality of code rings rotatable about an axis of rotation and a latch that is preloaded along the axis of rotation in the direction of a locked position. The lock body has an introduction opening through which the locking bar of the jointed bar hoop can be introduced into the lock body along an introduction direction that is oriented transversely to the axis of rotation of the code rings, with the locking bar introduced into the lock body being locked to the lock body when the latch is in the locked position and is blocked. The latch and/or the locking bar of the jointed bar hoop has/have at least one slope that is configured to effect an urging back of the preloaded latch from the locked position into a release position on a removal of the locking bar from the introduction opening of the lock body and/or on an introduction of the locking bar into the introduction opening of the lock body.

18 Claims, 7 Drawing Sheets

(56) References Cited

U.S. PATENT DOCUMENTS

Figure 1:
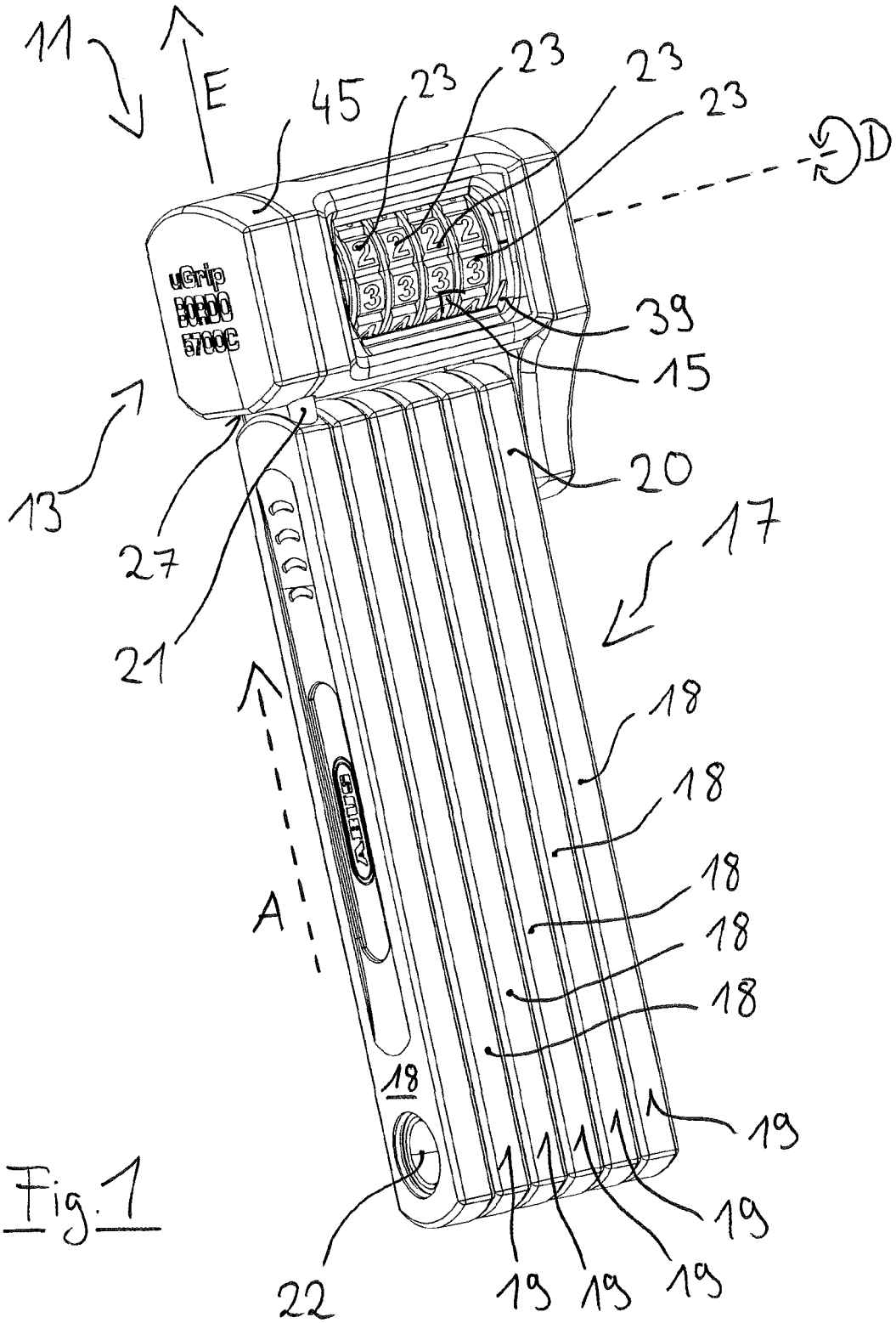

| | | | | |
|---|---|---|---|---|
| 8,156,772 | B2 * | 4/2012 | Buhl | E05B 71/00 70/53 |
| 9,217,265 | B2 * | 12/2015 | Muller | E05B 67/003 |
| D927,961 | S * | 8/2021 | Drechsel | D8/336 |
| 2007/0101779 | A1 * | 5/2007 | Muerza | B62H 5/001 70/233 |
| 2008/0196454 | A1 * | 8/2008 | Frantz | E05B 67/36 70/14 |

FOREIGN PATENT DOCUMENTS

| | | | |
|---|---|---|---|
| DE | 3410047 | A1 | 10/1985 |
| DE | 102007035116 | A1 | 1/2009 |
| DE | 102010036636 | A1 | 2/2012 |
| EP | 0831196 | A2 | 3/1998 |
| EP | 2333204 | A1 | 6/2011 |

* cited by examiner

JOINT LOCK

CROSS-REFERENCE TO RELATED APPLICATIONS

This application claims the benefit and priority of German Application No. DE 102019113378.5, filed May 20, 2019. The entire disclosure of the above application is incorporated herein by reference.

FIELD

The invention relates to a joint lock, in particular for two-wheelers, having a lock body that accommodates a combination locking mechanism and having a jointed bar hoop that has a plurality of jointed bars pivotably connected to one another and a locking bar. In such a joint lock, a first end of the jointed bar hoop can be permanently fastened to the lock body, wherein a second end of the jointed bar hoop has the locking bar. The combination locking mechanism of such a joint lock can have a plurality of code rings rotatable about an axis of rotation and a latch that is preloaded along the axis of rotation in the direction of a locked position, wherein the latch is movable in the direction of a release position when a secret code is set at the code rings, and wherein the latch is blocked in the locked position when the secret code is not set at the code rings. The lock body has an introduction opening through which the locking bar of the jointed bar hoop can be introduced into the lock body along an introduction direction that is oriented transversely to the axis of rotation of the code rings, with the locking bar introduced into the lock body being locked to the lock body when the latch is in the locked position and is blocked.

BACKGROUND

This section provides background information related to the present disclosure and which is not necessarily prior art.

Such a joint lock is, for example, known from DE 10 2007 035 116 A1 whose contents are included in the present disclosure with respect to the general operation of a joint lock. Such joint locks can, for example, be used to secure a two-wheeler, for which purpose the mutually connected jointed bars of the jointed bar hoop can first be pivoted apart or folded such that the jointed bar hoop can be guided through a section of the two-wheeler, for example a frame section, and around an object fixed in a stationary manner, for example a bicycle stand, a lantern or a fence. The free end of the jointed bar hoop that has the locking bar can then be introduced into the introduction opening of the lock body and locked thereto so that the jointed bar hoop forms a closed loop that connects the two-wheeler to the object fixed in a stationary manner and secures it thereat. The closed loop formed by the jointed bar hoop can furthermore be guided through the spokes of one of the running wheels of the two-wheeler such that the movement of said two-wheeler is bounded and an unauthorized riding away can be prevented.

Such joint locks can have a combination locking mechanism by means of which a secret code can be set to enable a release of the latch for a movement into the release position and to be able to release the locking bar from the lock body. Such a secret code can, for example, consist of a predetermined sequence of numbers that is selected by the user and that can be set by a rotation of the code rings in a viewing window of the lock body. In addition to such a numerical encryption, other forms of the coding are also possible, e.g. through different shapes, letters or colors shown on the code rings. Due to the blocking and release of the latch by inputting a secret code, a secure locking of the locking bar to the lock body and a removal of the locking bar desired by the user can be achieved by a rotation of the code rings about the axis of rotation so that no key has to be taken along to actuate the lock. The risk that the lock can no longer be actuated due to a loss of a key can thus also be counteracted. These advantages of a joint lock having a combination locking mechanism are opposed by the more complicated handling of known solutions in which the secret code first has to be set and the locking mechanism subsequently has to be unlocked by a manual actuation. Only then can the locking bar be removed.

SUMMARY

This section provides a general summary and is not intended to be considered an exhaustive and comprehensive listing of all objects and embodiments of the present disclosure.

It is an object of the invention to provide a simple and comfortable possibility of handling a joint lock having a combination locking mechanism.

This object is satisfied by a joint lock having the features of claim 1 and in particular in that the latch and/or the locking bar has/have at least one slope that is configured to effect an urging back of the preloaded latch from the locked position into the release position on a removal of the locking bar from the introduction opening of the lock body and/or on an introduction of the locking bar into the introduction opening of the lock body.

The invention thus in general form relates to a joint lock having a lock body that accommodates a combination locking mechanism and having a jointed bar hoop that has a plurality of jointed bars pivotably connected to one another and a locking bar, wherein the combination locking mechanism has a plurality of code rings rotatable about an axis of rotation and a latch that is preloaded along the axis of rotation in the direction of a locked position; wherein the lock body has an introduction opening through which the locking bar of the jointed bar hoop can be introduced into the lock body along an introduction direction that is oriented transversely (in particular orthogonally) to the axis of rotation of the code rings, with the locking bar introduced into the lock body being locked to the lock body when the latch is in the locked position and is blocked by means of the code rings; and wherein the latch and/or the locking bar of the jointed bar hoop has/have at least one slope that is configured to effect an urging back of the preloaded latch from the locked position into a release position on a removal of the locking bar from the introduction opening of the lock body and/or on an introduction of the locking bar into the introduction opening of the lock body.

The invention is based on the fact that, due to the preload of the latch in the direction of the locking position, it is possible after the introduction of the locking bar into the introduction opening to hold the locking bar in the lock body without the latch already being blocked in the locked position. It is thus possible to first introduce the locking bar into the lock body and then to adjust the combination at the code rings, wherein a user can operate the locking mechanism comfortably and with both hands due to the holding of the locking bar on the basis of the preload of the latch. Furthermore, it can thus be prevented that the locking bar releases from the lock body in an unintentional and uncontrolled manner by a setting of the secret code to be able to remove the locking bar from the lock body, which could result in damage both to the jointed bar hoop and to a secured object. A removal of the locking bar is thus only possible by a deliberate and controlled action of a user, in particular by an active pulling out of the locking bar from the lock body.

Since the latch and/or the locking bar has/have at least one slope, an urging back of the preloaded latch into the release position can be effected on a movement of the locking bar in the introduction opening in the introduction direction (during an introduction) and/or against the introduction direction (during a removal) when the secret code is set at the code rings. A (temporary) urging back of the latch hereby takes place directly by the active movement of the locking bar. However, due to the preload of the latch and the cooperation via the slope, it is also necessary to apply an increased force (in or against the introduction direction). The requirement of an increased force expenditure is perceptible to the user so that an incorrect operation is prevented. Nevertheless, the necessary increased force expenditure does not represent a substantial impairment of the operating comfort since the locking bar anyway has to be gripped and moved by the user.

However, the user does not also have to grip and actuate an additional control element (such as a push-button of the lock body); thus additional actuation steps for the introduction or removal of the locking bar are therefore not necessary. It is therefore not possible to introduce the locking bar into the introduction opening or to remove it therefrom without a further means having to be provided or actuated for this purpose. To enable the movement of the latch into the release position, it is merely necessary that the secret code is set at the code rings so that the latch is not blocked by the code rings and a movement of the latch is blocked.

It can thus be achieved by the slope or slopes of the latch and/or of the locking bar to translate the movement of the locking bar in or against the introduction direction, that is a movement of the locking bar transverse to the axis of rotation of the combination locking mechanism, into an axial movement of the latch in the direction of the release position. The at least one slope can for this purpose extend obliquely to the axis of rotation and/or to the introduction direction in order to effect the latch movement. Due to the indirect drive of the latch in the direction of the release position, the locking bar can be introduced into the introduction opening or removed therefrom without additional actuation steps if the secret code is set at the code rings. It can nevertheless be achieved by the preload of the latch in the direction of the locked position that the introduced locking bar is held in the lock body even if the latch is not blocked by the code rings. An unintentional or uncontrolled release of the locking bar from the lock body can thus be prevented and, due to the holding of the locking bar, a user can comfortably adjust the combination at the code rings with both hands after the introduction of the locking bar into the introduction opening. A particularly simple and comfortable use of the joint lock is thus made possible, in particular with respect to the introduction and removal of the locking bar.

The introduction opening of the lock body mentioned in connection with the invention generally designates the opening visible at the outer side of the lock body for the introduction of the locking bar and also the inner space which adjoins said opening and in which the locking bar introduced extends. In this respect, the introduction opening can also be designated as an introduction passage for the locking bar.

Provision can be made that, due to the introduction of the locking bar into the introduction opening of the lock body, the latch is temporarily movable against the preload from the locked position into the release position when the secret code is set at the code rings, wherein the latch is moved back into the locked position due to its preload when the locking bar is completely introduced into the lock body. The latch can therefore be automatically moved on an introduction into the release position so that a user does not have to take any further steps to enable an introduction of the locking bar. Since the latch is thereupon automatically moved back into the locked position due to its preload, the locking bar can immediately be held in the lock body so that its user can change the combination at the code rings comfortably and with both hands in order to block the locking bar in the lock body. The user himself thus has to provide a movement of the latch into the locked position before he blocks it by an adjustment of the secret code.

Provision can also be made that, due to a removal of the locking bar from the introduction opening of the lock body, the latch is temporarily movable against the preload from the locked position into the release position when the secret code is set at the code rings, wherein the latch is moved back into the locked position again due to its preload when the locking bar is completely removed from the lock body. A removal of the locking bar by the user in this respect also merely requires the setting of the secret code at the code rings, wherein the necessary movement of the latch into the release position automatically takes place on a removal of the locking bar. It can, in turn, be achieved by the preload of the latch that the locking body is also held at the lock body when the secret code is set at the code rings and does not release from said lock body directly and in an uncontrolled manner. Due to the return movement of the latch into the locked position after the removal of the locking bar, the possibility of holding the locking bar in the lock body without blocking the latch by the code rings can already be prepared for a subsequent reintroduction of the locking bar.

In some embodiments, the at least one slope can extend along a plane that is intersected at an acute angle by the axis of rotation of the combination locking mechanism and/or whose normal extends within a plane that is spanned by the axis of rotation and the introduction direction. The planar design of the slope can enable an easy production and a particularly smooth cooperation between the locking bar and the latch. This slope can in this respect in particular be intersected at an angle of between 30 degrees and 60 degrees from the axis of rotation of the combination locking mechanism. The orientation of the at least one slope in a plane whose surface normal extends within a plane spanned by the axis of rotation and the introduction direction can also effect a particularly smooth cooperation between the locking bar and the latch and furthermore a defined translation of a movement of the locking bar along or against the introduction direction into an axial movement of the latch in the direction of the release position.

The radial spacing of the at least one slope from the axis of rotation can increase in the direction of the release position of the latch. Due to this increasing radial spacing of the slope from the axis of rotation, a larger region is thus always cleared in the direction of the release position of the latch, so that the latch is urged in this direction, on an introduction or a removal of the locking bar in or from an introduction direction that is oriented transversely to the axis of rotation.

In some embodiments, the latch can have a release slope and the locking bar can have a removal slope, said slopes being configured to effect an urging back of the preloaded latch from the locked position into the release position on a removal of the locking bar from the introduction opening of the lock body. The latch and the locking bar are in this respect consequently matched to one another such that the latch is automatically displaced into the release position by the release slope and the removal slope during a removal of the locking bar when the secret code is set at the code rings. Due to this cooperation of the two slopes, a defined and uniform latch movement can be made possible and a possible canting of the locking bar during the removal can be prevented.

The release slope and the removal slope can extend in parallel with one another and/or can substantially contact one another when the locking bar is introduced into the introduction opening. Due to this parallel extent of the release slope and the removal slope, a defined and uniform latch movement can initially be made possible without fluctuations in the necessary force expenditure that are perceptible to the user or uncontrolled movements of the latch occurring in so doing. Furthermore, the two slopes can substantially extend contacting one another when the locking bar is introduced into the introduction opening and is locked by the latch that is in the locked position so that the two slopes can cooperate directly at the start of the removal of the locking bar from the introduction opening without a noticeable delay or a significant abutment of the locking bar at the latch taking place. Furthermore, a movement of the locking bar in the locked state can be bounded and a noise formation can be reduced in this manner, with a slight clearance or tolerances between the two slopes being unproblematic.

In some embodiments, the latch can have a reception slope and the locking bar can have an introduction slope, said slopes being configured to effect an urging back of the latch from the locked position into the release position on an introduction of the locking bar into the introduction opening of the lock body. The reception slope of the latch and the introduction slope of the locking bar thus cooperate such that the latch is urged into the release position on an introduction of the locking bar into the introduction opening when the secret code is set at the code rings. Since the latch and the locking bar are matched to one another in such a manner, a defined and uniform movement of the latch into the release position can be achieved during the introduction of the locking bar.

The reception slope and the introduction slope can extend in parallel with one another. Due to such a parallel extent, a uniform movement of the latch in the direction of the release position during the introduction of the locking bar can be achieved without force fluctuations noticeable to the user occurring during this latch movement.

In some embodiments, the locking bar can have a removal slope (in particular the removal slope already mentioned) and a boundary slope that together bound an engagement recess in the locking bar into which the latch engages when the locking bar is introduced into the introduction opening. The boundary slope of the locking bar can in this respect in particular extend in parallel with a reception slope (in particular with the reception slope already mentioned) of the latch, wherein the boundary slope of the locking bar and the reception slope of the latch can substantially contact one another when the locking bar is introduced into the introduction opening and the latch is in the locked position. Furthermore, as already explained, the removal slope of the introduced locking bar can substantially extend contacting a release slope (in particular the release slope already mentioned) of the latch so that a removal of the locking bar from the introduction opening is directly converted into an axial movement of the latch in the direction of the release position. Production tolerances that result in a slight clearance between the respective pairs of slopes are unproblematic in this respect.

Due to the cooperation of the boundary slope of the locking bar with the reception slope of the latch, the introduction depth of the locking bar can in this respect in particular be defined on the introduction into the introduction opening. Furthermore, a secure holding or locking of the locking bar in the lock body can be achieved by the engagement recess of the locking bar. Provided that the introduction slope and the boundary slope of the locking bar cooperate with a respective slope of the latch, the slopes formed at the latch can in particular fulfill a dual function both by engaging into the recess of the locking bar to securely lock it to the lock body and by serving for the urging back of the latch in the direction of the release position on a movement of the locking bar in or against the introduction direction.

In some embodiments, the combination locking mechanism can be held in a holder, with the holder being able to have an abutment that is configured to bound a movement of the latch effected by the preload of the latch in the direction of the locked position. This holder can in particular be cage-like such that the code rings for setting or adjusting the secret code are easily accessible from the outside by a user or a window can be provided for checking the set combination at the code rings. The abutment can be formed integrally in a bonded manner at the holder. The lock body can have a housing in which, in turn, the holder for the combination locking mechanism is received.

Due to its preload, the latch engages into the introduction opening in the locked position (in particular transversely to the introduction direction). Due to the bounding of the movement of the latch in the direction of the locked position by means of the abutment, a maximum engagement of the latch into the introduction opening of the lock body or of the housing can be defined, in particular if the locking bar is not located in the introduction opening. It can in particular thereby be achieved that the latch does not project too deeply into the introduction opening when the locking bar is removed and an urging back of the latch by the introduction of the locking bar is hereby made more difficult. Due to the provision of the abutment at the holder of the combination locking mechanism, the end position of the latch in the locked position can be defined particularly precisely and without tolerance chains since the holder, on the one hand, adopts a predetermined position within the lock body (in particular the housing) and thus with respect to the introduction opening for the locking bar and, on the other hand, adopts a predetermined position relative to the combination locking mechanism and in particular to the latch.

The abutment of the holder can thus define a maximum engagement of the latch into the introduction opening in the locked position. Accordingly, it is possible that the latch engages less far into the introduction opening when the locking bar is introduced and the movement of the latch in the locked position is bounded by the locking bar. If, in contrast, the locking bar is removed from the introduction opening, the maximum engagement of the latch can be achieved and can be defined by the abutment of the holder so that it is in particular prevented that the latch only abuts the lateral boundary of the introduction opening or of the lock body disposed opposite the latch and the latch thus completely passes through the introduction opening.

In accordance with an embodiment, the maximum engagement of the latch into the introduction opening of the lock body defined by the abutment can differ from a position of a reduced engagement which the latch adopts when the locking bar is introduced into the introduction opening and the latch contacts the locking bar, with the code rings of the combination locking mechanism only being rotatable when the latch adopts the position of the reduced engagement, but not when the latch is in the position of the maximum engagement.

It can hereby be achieved that a coding set at the code rings can only be changed when the locking bar is introduced into the introduction opening. If the locking bar is, in contrast, released from the lock body after a setting of the secret code, the latch reaches the position of the maximum engagement defined by the abutment and the code rings are not rotatable. This can, for example, prevent an accidental setting of a coding different from the secret code by a random contact at the code rings when the locking bar is removed. Such an adjustment would result in a blocking of the latch so that a user can only insert the locking bar again after he has reset the secret code at the code rings. Such an unwanted blocking can consequently be prevented by the fixing of the code rings when the locking bar is removed so that a user can introduce the locking bar without impediment at any time and can selectively lock it.

Such a prevention of a rotation of the code rings when the locking bar is removed can, for example, be achieved in that the latch in its maximum engagement projects so far with respect to the position of the reduced engagement that a positioning of the elements of the code rings blocking the latch (e.g. radially inwardly directed elevated portions in the form of a ring section) is blocked by the latch. A respective elevated portion configured to block the latch at the code rings or connected to said code rings can in particular engage radially inwardly into associated blocking recesses of the latch in order to block an axial movement of the latch. In the position of the maximum engagement of the latch, a screwing in of these elevated portions can be prevented by teeth of the latch that separate the blocking recesses of the latch from one another, namely in that the teeth of the latch are positioned into a respective intermediate space in the direction of rotation in front of the elevated portions of the code rings. Such a formation of the latch with blocking recesses and teeth separating them can, for example, be seen from FIGS. 2, 3 and 6 (blocking recess 26).

In some embodiments, the lock body can have a preload spring that cooperates with the latch at an end of the latch disposed in the direction of the release position such that the latch is preloaded in the direction of the locked position. As mentioned above, it can be achieved by this preload of the latch that a locking bar introduced into the introduction opening is held at the lock body even if the secret code is set at the code rings and the latch is accordingly not blocked or is blocked in the locked position. A preload spring furthermore represents a simple and space-saving possibility of producing this preload that enables a use in the bounded space of the lock body.

The locking bar can have a longitudinal axis and can be axially introduced into the introduction opening of the lock body with respect to the longitudinal axis or the locking bar is laterally pivotable into the introduction opening of the lock body. The longitudinal axis of the locking bar in this respect extends in the direction of the greatest extent. Such a respective longitudinal axis can also be defined for the jointed bars, wherein these longitudinal axes likewise extend along the direction of the greatest extent of the respective jointed bar. On an axial introduction of the locking bar into the introduction opening of the lock body, said locking bar is introduced into the lock body substantially in a straight line from a direction facing transversely to the axis of rotation of the combination locking mechanism. Alternatively, the locking bar is laterally pivotable into the introduction opening of the lock body, wherein the axis of rotation of the combination locking mechanism is oriented transversely and in particular orthogonally to the longitudinal axis of the locking bar when the locking bar is introduced into the lock body. The movement path of the locking bar on the lateral introduction into the lock body can in particular extend in a normal plane to the axis of rotation of the combination locking mechanism in the region of the lock body.

The jointed bars and the locking bar can be formed in a straight line.

In some embodiments, the jointed bar hoop is foldable into a yardstick configuration in which the jointed bars and the locking bar are aligned in parallel with one another. In such a configuration, the jointed bar does not form a loop or a chain, but is rather folded in compact form, which can e.g. enable a stowing of the joint lock in a holder.

The longitudinal axes of the jointed bars and of the locking bar preferably extend in a plane in parallel with one another in the yardstick configuration of the jointed bar hoop.

The lock body can extend along a longitudinal axis, with the longitudinal axis of the lock body extending within a plane which is spanned by the longitudinal axes of the jointed bars and of the locking bar in the yardstick configuration of the jointed bar hoop.

The lock body can be arranged within a plane of extent of the jointed bar hoop in the yardstick configuration of the jointed bar hoop so that the lock body and the jointed bar hoop can together form a flat packet.

The longitudinal axis of the lock body can in particular extend in parallel with the axis of rotation of the combination locking mechanism or can coincide therewith.

Due to a parallel alignment of the jointed bars and the locking bar and to the orientation of the longitudinal axis or of the greatest extent of the lock body in a plane spanned by these longitudinal axes, the space requirement of the folded joint lock can be minimized so that the lock body and the jointed bar hoop can form a flat packet. This enables a simple stowing or a simple transport of the joint lock, which can in particular be desired in the case of joint locks that are used to secure two-wheelers and are accordingly frequently transported.

In some embodiments, the combination locking mechanism can have a combination adjustment mechanism that is arranged at an end of the combination locking mechanism disposed in the direction of the release position. Due to such a combination adjustment mechanism, it is possible to change the secret code, that is the association of the respective rotational position of the outer sections of the code rings, which are visible from the outside, with their inner sections that release or block the latch. This combination adjustment mechanism can be arranged at an end of the combination locking mechanism disposed in the direction of the release position so that the combination adjustment mechanism does not impair the space required for the introduction opening and for the cooperation of the latch and the locking bar.

The invention also relates, independently of the explained slopes of the latch and of the locking bar, to a lock (in particular a joint lock, a cable lock or a chain lock) having a lock body that accommodates a combination locking mechanism and having a hoop (in particular a jointed bar hoop, a U-shaped hoop, a wire rope or a chain), wherein the hoop can be introduced into at least one introduction opening of the lock body and is selectively lockable to the lock body, wherein the combination locking mechanism has a plurality of code rings rotatable about an axis of rotation and a latch that is preloaded along the axis of rotation in the direction of a locked position, wherein the latch is movable in the direction of a release position when a secret code is set at the code rings, and wherein the latch is blocked in the locked position when the secret code is not set at the code rings; wherein the locking bar introduced into the lock body is locked to the lock body when the latch is in the locked position and is blocked; wherein the lock body has an abutment that is configured to bound a movement of the latch effected by the preload of the latch in the direction of the locked position; wherein the abutment defines a maximum engagement of the latch into the introduction opening of the lock body in the locked position of the latch; wherein the maximum engagement of the latch into the introduction opening of the lock body defined by the abutment differs from a position of a reduced engagement which the latch adopts when the hoop is introduced into the introduction opening and the latch contacts the hoop; and wherein the code rings of the combination locking mechanism are only rotatable when the latch adopts the position of the reduced engagement, but not when the latch is in the position of the maximum engagement.

The already explained advantages of an abutment for the latch can hereby also be achieved with other types of joint locks and with other types of locks, in particular two-wheeler locks. The hoop can thus be a flexible hoop or a rigid hoop. One end of the hoop can be permanently fastened to the lock body and only the other end can be introduced into the lock body (e.g. in the case of a joint lock, a cable lock or a chain lock); or two ends of the hoop are introduced into a respective introduction opening of the lock body (e.g. a joint lock, a U-shaped hoop lock). In another respect, the further developments explained above can also be transferred to such a lock having two different engagement positions of the latch (e.g. a preload spring).

DRAWINGS

Figure 2:
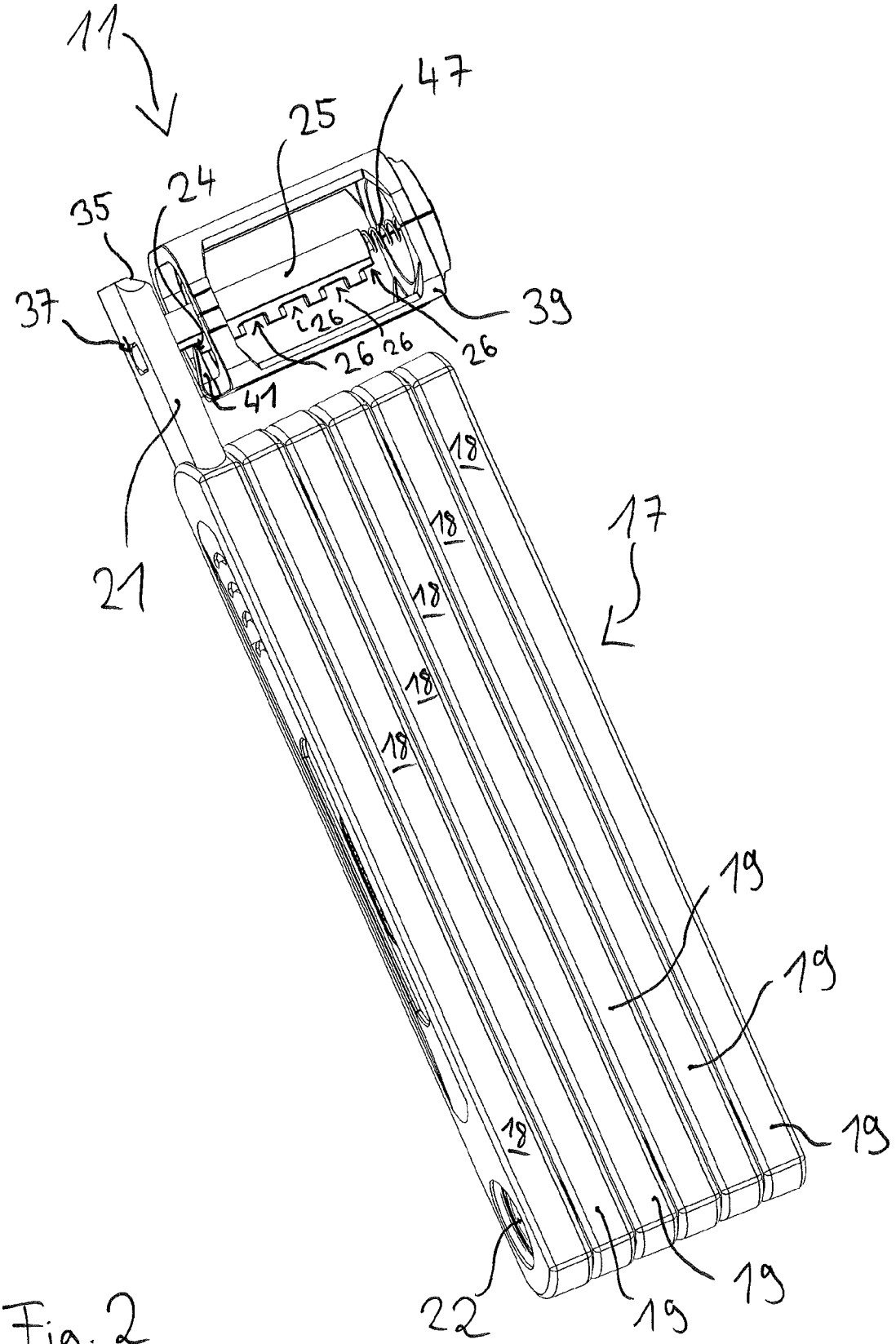
Figure 3:
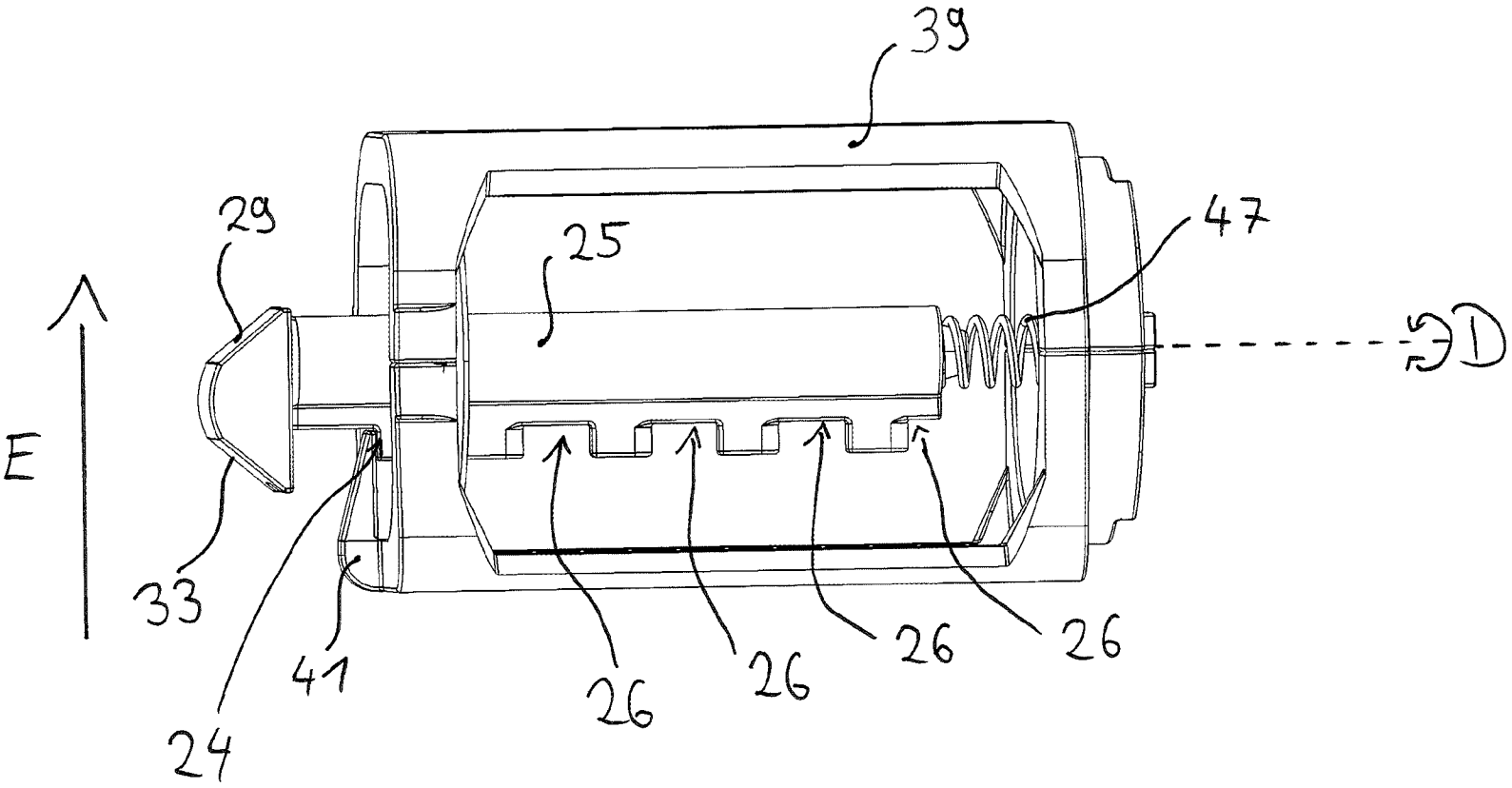
Figure 4:
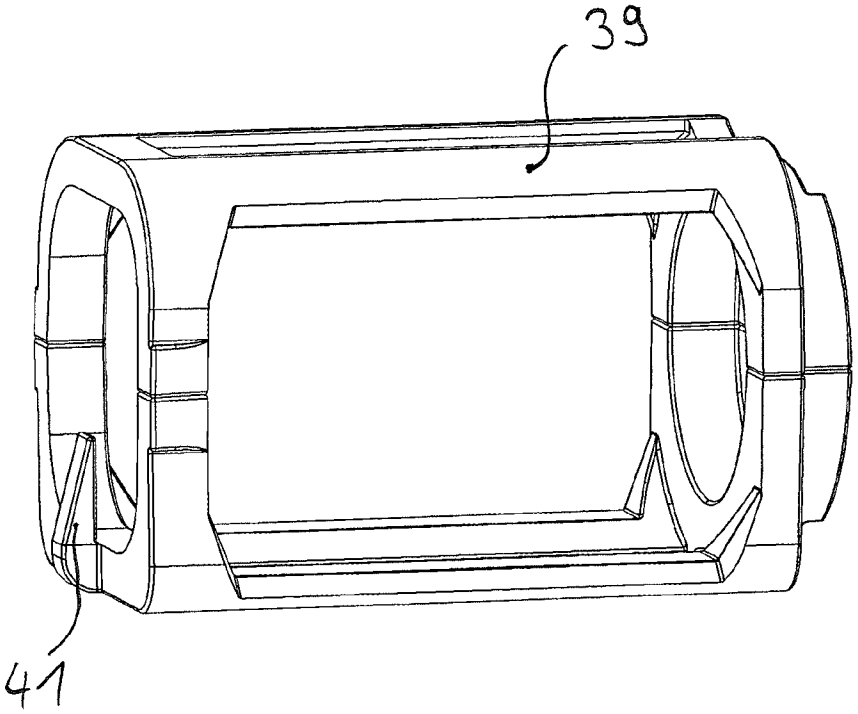
Figure 5A:
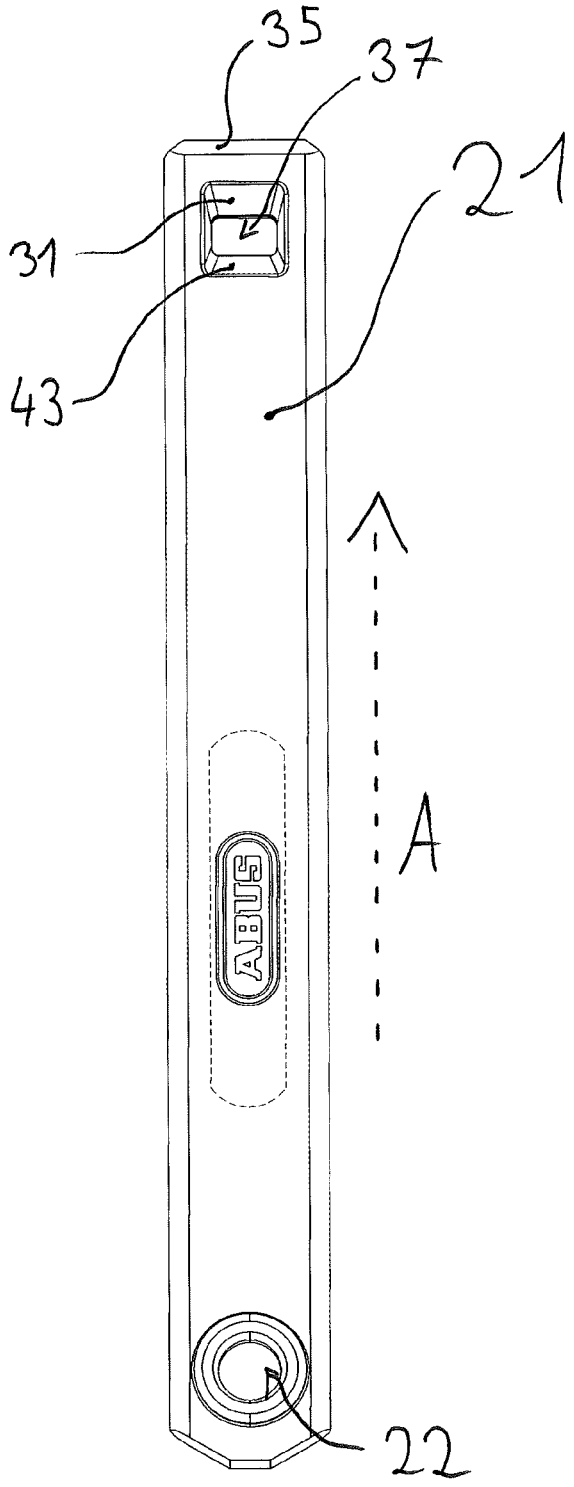
Figure 5B:
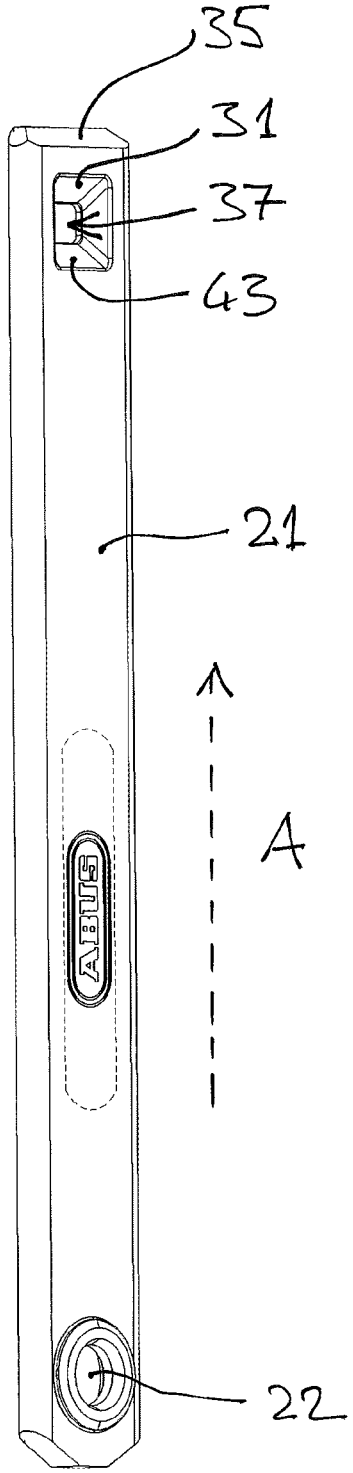

The invention will be described in the following purely by way of example with reference to the drawings. They only represent possible embodiments, wherein further embodiments can be seen from the description and the claims. There are shown:

FIG. 1: a perspective representation of a joint lock;

FIG. 2: a perspective representation of the joint lock when the combination locking mechanism is removed and the cover is removed to illustrate the engagement of the latch into the locking bar in the locked position;

FIG. 3: a side view of the latch received in the holder;

FIG. 4: a perspective side view of the holder;

FIG. 5A: a plan view of the locking bar;

FIG. 5B: a perspective representation of the locking bar; and

Figure 6:
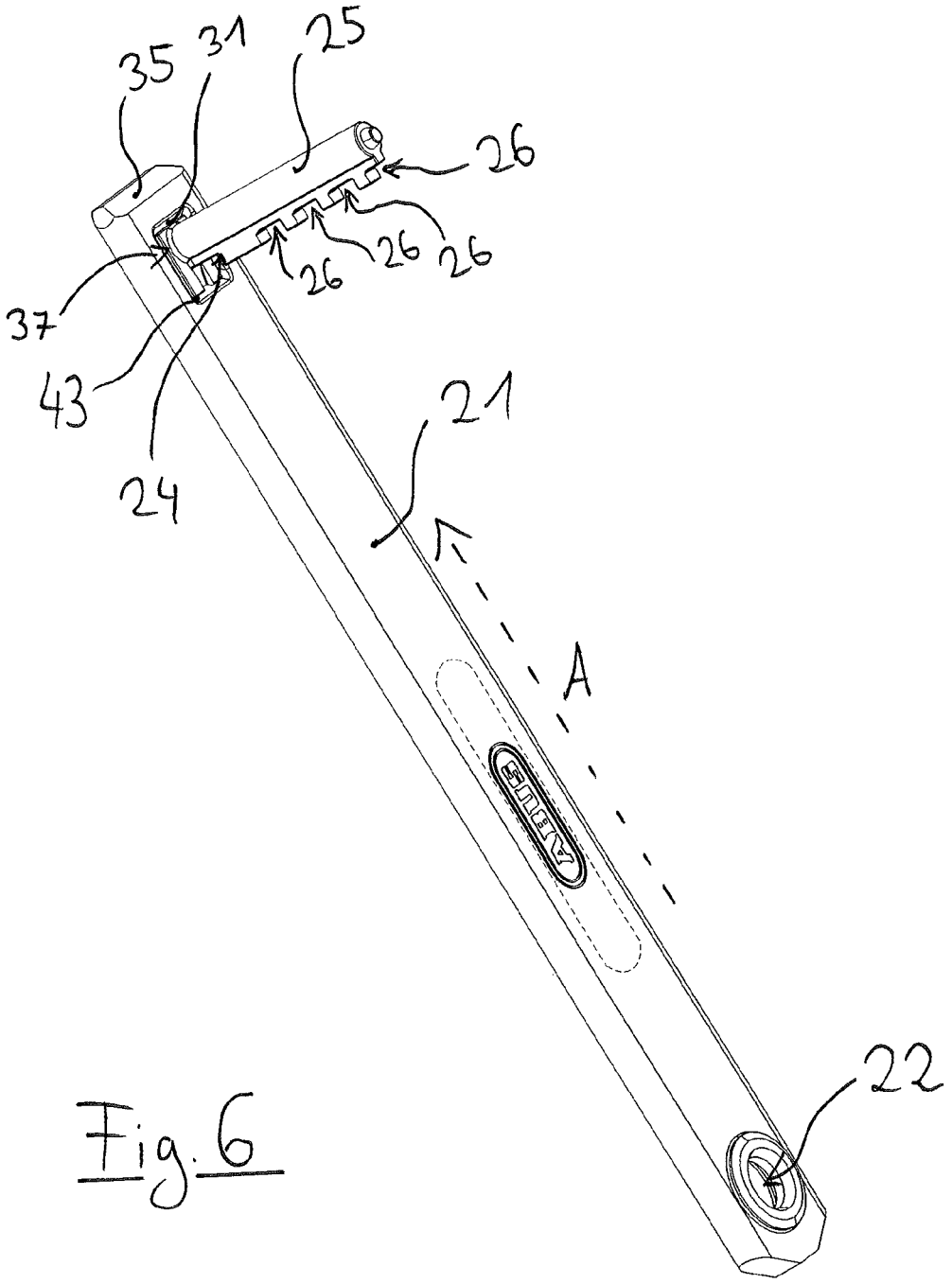

FIG. 6: a perspective representation for illustrating the cooperation of the latch with the locking bar in the locked position.

DETAILED DESCRIPTION

FIG. 1 shows a joint lock 11 that has a lock body 13 to which a jointed bar hoop 17 is fastened in an articulated manner. The jointed bar hoop 17 comprises five jointed bars 19 and a locking bar 21 that are pivotably connected to one another via a plurality of pivotal connections 22. The respective pivotal connection 22 comprises a rivet. Only the pivotal connection 22 of the locking bar 21 to the adjacent jointed bar 19 can be seen in FIG. 1. The locking bar 21 forms a free end of the jointed bar hoop 17 and can be introduced along an introduction direction E into an introduction opening 27 of the lock body 13 and can be selectively locked to or released from the lock body 13 there. The introduction direction E here corresponds to the longitudinal axis A of the locking bar 21. The end 20 of the jointed bar hoop 17 opposite the locking bar 21 is connected to the lock body 13 in a permanent, but likewise articulated manner.

Furthermore, both the jointed bars 19 and the locking bar 21 of the jointed bar hoop 17 have a respective jacket 18. This jacket 18 can, for example, be produced from a plastic to provide protection against damage and to enable a comfortable handling of the jointed bar hoop 17.

In the state shown in FIG. 1, the jointed bar hoop 17 is folded into a so-called yardstick configuration in which the jointed bars 19 and the locking bar 21 are aligned in parallel with one another.

The lock body 13 accommodates a combination locking mechanism 15 that is surrounded by a housing (not shown) and a cover 45. The housing serves for the securing against break-open attempts and can be produced from metal. The cover 45 can, for example, be produced from a plastic to enable a comfortable handling of the lock. Furthermore, the inner space of the lock body 13 can be protected from contamination by the cover 45.

The combination locking mechanism 15 has four code rings 23 that are rotatable about an axis of rotation D. In the embodiment shown here, the introduction direction E of the locking bar 21 and the axis of rotation D of the code rings 23 are precisely orthogonally aligned with respect to one another. Due to a rotation of the code rings 23, a secret code can be set that can enable a movement of a latch 25 (cf. FIGS. 2 and 3) along the axis of rotation D from a locked position into a release position to release a received locking bar 21 from the lock body 13. Due to a setting of a combination at the code rings 23 that does not correspond to the secret code, the latch 25 can, in contrast, be blocked in the locked position in that inwardly disposed sections of the code rings 23, not shown, engage into a respective blocking recess 26 of the latch 25 (cf. FIG. 2). Furthermore, the combination locking mechanism 15 is held in a cage-like holder 39 that enables a defined positioning of the combination locking mechanism 15 in the lock body 13.

As FIG. 2 shows, the combination locking mechanism 15 comprises the latch 25 which is peripherally surrounded by the code rings 23 and by means of which the locking bar 21 introduced into a lateral introduction opening 27 of the lock body 13 can be locked to the lock body 13. In FIG. 2, this latch 25 is in the locked position and engages into a recess 37 of the introduced locking bar 21. In this respect, the latch 25 is preloaded in the direction of the locked position by means of a preload spring 47 so that it is also possible to hold the locking bar 21 in the lock body 13 when the secret code is set at the code rings 23 and the latch 25 is generally released for a movement against the preload in the direction of the release position. After an introduction of the locking bar 21, the latter can thus already be held at the lock body so that a user can adjust the combination at the code rings comfortably and with both hands without the locking bar releasing from the lock body 13 in an unwanted or uncontrolled manner. Equally, it can be prevented by this preload of the latch 25 in the direction of the locked position that a locking bar 21 introduced into the introduction opening 27 of the lock body 13 releases directly and in an uncontrolled manner from the lock body and, for instance, falls out unintentionally due to a setting of the secret code.

As can in particular be seen from FIGS. 3 and 4, the holder 39 has an abutment 41 that bounds a movement effected by the preload of the latch 25 in the direction of the locked position. In this respect, the abutment 41 cooperates with an abutment point 24 of the latch 25. Due to this cooperation of the abutment 41 with the abutment point 24 of the latch 25, a maximum (lateral) engagement of the latch 25 into the introduction opening 27 of the lock body 13 can consequently be defined. It can thereby, for example, be prevented that the latch 25 projects too deeply into the introduction opening 27 of the lock body 13 when the locking bar 21 is removed.

Furthermore, the latch 25 has a release slope 29 and a reception slope 33 in the direction of the locked position or at its end remote from the preload spring 47. It is made possible by these slopes 29, 33 that an urging back of the latch 25 against the preload and thus in the direction of the release position takes place (provided that the secret code is set at the code rings 23) due to an introduction or a removal of the locking bar 21 in or against the introduction direction E. These slopes 29, 33 are in this respect formed as planar surfaces and each extend in such a plane that is intersected at an acute angle by the axis of rotation D of the combination locking mechanism 15. The respective radial spacing of the slopes 29, 33 from the axis of rotation D increases in the direction of the release position in so doing. This design makes it possible that, on an introduction of the locking bar 21 in the introduction direction E or on its removal against the introduction direction E, the locking bar 21 can urge the latch 25 against the preload by the preload spring 47 in the direction of the release position.

The locking bar 21 shown in FIGS. 5A and 5B has an introduction slope 35 at its end disposed opposite the pivotal connection 22, said introduction slope 35 first being introduced on an introduction of the locking bar 21 into the introduction opening 27 of the lock body 13. On an introduction of the locking bar 21 in the introduction direction E, this introduction slope 35 can cooperate with the reception slope 33 of the latch 25 shown in FIG. 3 to enable a (temporary) urging back of the latch 25 against the preload of the preload spring 47 into the release position. In this respect, the introduction slope 35 of the locking bar 21 and the reception slope 33 of the latch 25 can in particular be configured such that they extend in parallel when the locking bar 21 is introduced into the introduction opening 27 along the introduction direction E. This can enable a defined and smooth drive of the latch 25 from the locked position into the release position without excessive force fluctuations or inaccuracies occurring for a user.

Furthermore, the locking bar 21 (cf. FIGS. 5A and 5B) has a recess 37 that is bounded by a removal slope 31 and a boundary slope 43. Due to these slopes 31 and 43 of the locking bar 21, it is made possible on the introduction of the locking bar 21 into the introduction opening 27 that, after the latch 25 has initially been urged back into the release position by the explained cooperation of the introduction slope 35 of the locking bar 21 and the reception slope 33 of the latch 25, the latch 25 can automatically engage into the recess 37 of the locking bar 21 due to its preload when a locked position of the locking bar 21 is reached in order to hold and ultimately lock the locking bar 21. The locking bar 21 can thereby at least be held at the lock body 13 in a force-transmitting manner even if the secret code is still set at the code rings 23. Due to a subsequent adjustment of the combination at the code rings 23, the latch 25 can then, however, be blocked in the locked position in that the code rings 23 engage into the blocking recesses 26 of the latch 25. Thus, the locking bar 21 is then secured at the lock body 13 in a form-fitted manner.

The removal slope 31 of the locking bar 21 can in particular extend in parallel with the release slope 29 of the latch 25 and can extend substantially contacting said release slope 29 if, in the explained state, the locking bar 21 is introduced into the lock body 13 and the latch 25 adopts the locked position. Equally, the boundary slope 43 of the locking bar 21 can extend in parallel with and contacting the reception slope 33 of the latch 25. A substantially form-fitted engagement of the latch 25 into the recess 37 of the locking bar 21 is thereby made possible so that the locking bar 21 is held in a defined position in the lock body 13 in the locked state and in particular in the blocked state and any movements are bounded, whereby a noise formation can also be prevented. However, slight free spaces between the respective mutually oppositely disposed slopes, for example due to production tolerances, are generally unproblematic in this respect.

For a removal of the locking bar 21 from the introduction opening 27 of the lock body 13 against the introduction direction E, the removal slope 31 of the locking bar 21 can cooperate with the release slope 29 of the latch 25 (cf. FIG. 3) in order, in turn, to effect a (temporary) displacement of the latch 25 from the locked position against the preload by the preload spring 47 in the direction of the release position. This naturally requires that the secret code has been set at the code rings 23. In turn, a defined and uniform movement of the latch 25 in the direction of the release position is in this respect made possible by the parallel extent of the removal slope 31 of the locking bar 21 and the release slope 29 of the latch 25. Furthermore, it can be achieved by an engagement with an exact fit of the latch 25 into the recess 37 of the locking bar 21 when the locking bar 21 is introduced into the lock body 13 that the translation of the movement of the locking bar 21 against the introduction direction E during a removal is directly translated into an axial movement of the latch 25 in the direction of the release position without any delays or a noticeable or audible abutment of the removal slope 31 of the locking bar 21 and the release slope 29 of the latch 25 taking place. As soon as the locking bar 21 has been removed from the introduction opening 27 of the lock body 13 in this manner and the introduction slope 35 has passed the latch 25, the latch 25 can snap back into the locked position due to its preload, with this movement, as explained, being bounded by the abutment 41 of the holder 39. In this state, the locking bar 21 can, provided that the secret code is still set at the code rings 23, again be introduced into the introduction opening 27 of the lock body 13.

FIG. 6 again shows the engagement of the latch 25 into the recess 37 of the locking bar 21. In this respect, the latch 25 engages with an exact fit into the recess 37 of the locking bar 21 that is bounded by the removal slope 31 and the boundary slope 43 of the locking bar 21. The boundary slope 43 in this respect in particular bounds the depth of the introduction of the locking bar 21 into the introduction opening 27 of the lock body 13 in the introduction direction E.

A simple handling of a joint lock 11 is thus made possible by such a joint lock 11 or by the respective cooperation of the introduction slope 35 of the locking bar 21 with the reception slope 33 of the latch 25 and the respective cooperation of the removal slope 31 of the locking bar 21 with the release slope 29 of the latch 25. Since the latch 25 is automatically temporarily displaced in the direction of the release position on an introduction of the locking bar 21 into the introduction opening 27 of the lock body 13 or on a removal of the locking bar 21 from the introduction opening 27 of the lock body 13 when the secret code is set at the code rings 23 of the combination locking mechanism 15, no further action by the user is necessary to displace the latch 25 into the release position. A user thus only has to set the secret code and can directly selectively introduce the locking bar 21 into the introduction opening 27 of the lock body 13 or release it from the lock body 13, wherein the latch 25 is hereby indirectly driven in the direction of the release position. Nevertheless, it is achieved by the preload of the latch 25 that the introduced locking bar 21 is held in the lock body 13 even if the secret code is set at the code rings 23 and the latch 25 is thus not blocked by the code rings 23. An unintentional release of the locking bar 21 from the lock body 13 is hereby prevented.

The invention claimed is:

1. A joint lock having a lock body that accommodates a combination locking mechanism and having a jointed bar hoop that has a plurality of jointed bars pivotably connected to one another and a locking bar, wherein a first end of the jointed bar hoop is permanently fastened to the lock body and a second end of the jointed bar hoop has the locking bar;

wherein the combination locking mechanism has a plurality of code rings rotatable about an axis of rotation and a latch that is preloaded along the axis of rotation in the direction of a locked position, wherein the latch is movable in the direction of a release position when a secret code is set at the code rings, and wherein the latch is blocked in the locked position when the secret code is not set at the code rings; and wherein the lock body has an introduction opening through which the locking bar of the jointed bar hoop can be introduced into the lock body along an introduction direction that is oriented transversely to the axis of rotation of the code rings, with the locking bar introduced into the lock body being locked to the lock body when the latch is in the locked position and is blocked, wherein at least one of the latch and the locking bar has at least one slope that is configured to effect an urging back of the preloaded latch from the locked position into the release position on a removal of the locking bar from the introduction opening of the lock body or on an introduction of the locking bar into the introduction opening of the lock body.

2. A joint lock in accordance with claim 1, wherein the at least one slope extends along a plane that is intersected at an acute angle by the axis of rotation of the combination locking mechanism.

3. A joint lock in accordance with claim 1, wherein the at least one slope extends along a plane whose normal extends within a plane that is spanned by the axis of rotation and the introduction direction.

4. A joint lock in accordance with claim 1, wherein the radial spacing of the at least one slope from the axis of rotation increases in the direction of the release position of the latch.

5. A joint lock in accordance with claim 1, wherein the latch has a release slope and the locking bar has a removal slope that are configured to effect an urging back of the preloaded latch from the locked position into the release position on a removal of the locking bar from the introduction opening of the lock body.

6. A joint lock in accordance with claim 5, wherein the release slope and the removal slope extend in parallel with one another.

7. A joint lock in accordance with claim 5, wherein the release slope and the removal slope substantially contact one another when the locking bar is introduced into the introduction opening.

8. A joint lock in accordance with claim 1, wherein the latch has a reception slope and the locking bar has an introduction slope, said slopes being configured to effect an urging back of the latch from the locked position into the release position on an introduction of the locking bar into the introduction opening of the lock body.

9. A joint lock in accordance with claim 8, wherein the reception slope and the introduction slope extend in parallel with one another when the locking bar is introduced into the introduction opening.

10. A joint lock in accordance with claim 1, wherein the locking bar has a removal slope and a boundary slope, with the removal slope and the boundary slope bounding a recess in the locking bar into which the latch engages when the locking bar is introduced into the introduction opening.

11. A joint lock in accordance with claim 1, wherein the lock body has a preload spring that cooperates with the latch at an end of the latch disposed in the direction of the release position such that the latch is preloaded in the direction of the locked position.

12. A joint lock in accordance with claim 1, wherein the locking bar has a longitudinal axis and can be axially introduced into the introduction opening of the lock body with respect to the longitudinal axis, or wherein the locking bar is laterally pivotable into the introduction opening of the lock body.

13. A joint lock in accordance with claim 1, wherein the jointed bar hoop is foldable into a yardstick configuration in which the jointed bars and the locking bar are aligned in parallel with one another.

14. A joint lock having a lock body that accommodates a combination locking mechanism and having a jointed bar hoop that has a plurality of jointed bars pivotably connected to one another and a locking bar, wherein a first end of the jointed bar hoop is permanently fastened to the lock body and a second end of the jointed bar hoop has the locking bar;

wherein the combination locking mechanism has a plurality of code rings rotatable about an axis of rotation and a latch that is preloaded along the axis of rotation in the direction of a locked position, wherein the latch is movable in the direction of a release position when a secret code is set at the code rings, and wherein the latch is blocked in the locked position when the secret code is not set at the code rings; and wherein the lock body has an introduction opening through which the locking bar of the jointed bar hoop can be introduced into the lock body along an introduction direction that is oriented transversely to the axis of rotation of the code rings, with the locking bar introduced into the lock body being locked to the lock body when the latch is in the locked position and is blocked, wherein at least one of the latch and the locking bar has at least one slope that is configured to effect an urging back of the preloaded latch from the locked position into the release position on a removal of the locking bar from the introduction opening of the lock body or on an introduction of the locking bar into the introduction opening of the lock body, wherein the combination locking mechanism is held in a holder, with the holder having an abutment that is configured to bound a movement of the latch effected by the preload of the latch in the direction of the locked position, wherein the lock body has a housing in which the holder is received.

15. A joint lock in accordance with claim 14, wherein the abutment defines a maximum engagement of the latch into the introduction opening of the lock body in the locked position of the latch.

16. A joint lock having a lock body that accommodates a combination locking mechanism and having a jointed bar hoop that has a plurality of jointed bars pivotably connected to one another and a locking bar, wherein a first end of the jointed bar hoop is permanently fastened to the lock body and a second end of the jointed bar hoop has the locking bar;

wherein the combination locking mechanism has a plurality of code rings rotatable about an axis of rotation and a latch that is preloaded along the axis of rotation in the direction of a locked position, wherein the latch is movable in the direction of a release position when a secret code is set at the code rings, and wherein the latch is blocked in the locked position when the secret code is not set at the code rings; and wherein the lock body has an introduction opening through which the locking bar of the jointed bar hoop can be introduced into the lock body along an introduction direction that is oriented transversely to the axis of rotation of the code rings, with the locking bar introduced into the lock body being locked to the lock body when the latch is in the locked position and is blocked, wherein at least one of the latch and the locking bar has at least one slope that is configured to effect an urging back of the preloaded latch from the locked position into the release position on a removal of the locking bar from the introduction opening of the lock body or on an introduction of the locking bar into the introduction opening of the lock body, wherein the combination locking mechanism is held in a holder, with the holder having an abutment that is configured to bound a movement of the latch effected by the preload of the latch in the direction of the locked position, wherein the abutment defines a maximum engagement of the latch into the introduction opening of the lock body in the locked position of the latch, wherein the maximum engagement of the latch into the introduction opening of the lock body defined by the abutment differs from a position of a reduced engagement which the latch adopts when the locking bar is introduced into the introduction opening and the latch contacts the locking bar, with the code rings of the combination locking mechanism only being rotatable when the latch adopts the position of the reduced engagement, but not when the latch is in the position of the maximum engagement.

17. A joint lock having a lock body that accommodates a combination locking mechanism and having a jointed bar hoop that has a plurality of jointed bars pivotably connected to one another and a locking bar, wherein a first end of the jointed bar hoop is permanently fastened to the lock body and a second end of the jointed bar hoop has the locking bar;

wherein the combination locking mechanism has a plurality of code rings rotatable about an axis of rotation and a latch that is preloaded along the axis of rotation in the direction of a locked position, wherein the latch is movable in the direction of a release position when a secret code is set at the code rings, and wherein the latch is blocked in the locked position when the secret code is not set at the code rings; and wherein the lock body has an introduction opening through which the locking bar of the jointed bar hoop can be introduced into the lock body along an introduction direction that is oriented transversely to the axis of rotation of the code rings, with the locking bar introduced into the lock body being locked to the lock body when the latch is in the locked position and is blocked, wherein the latch and the locking bar each have at least one slope that interact with each other to effect an urging back of the preloaded latch from the locked position into the release position on a removal of the locking bar from the introduction opening of the lock body or on an introduction of the locking bar into the introduction opening of the lock body, wherein the interacting slopes are planar.

18. A joint lock in accordance with claim 17, wherein the interacting slopes extend in parallel with one another.

* * * * *